US009833049B1

(12) United States Patent
Winters

(10) Patent No.: US 9,833,049 B1
(45) Date of Patent: Dec. 5, 2017

(54) MULTI-PURPOSE PERAMBULATION AID WITH CONCEALED LOCKING MEANS

(71) Applicant: David Douglas Winters, Clarksville, TN (US)

(72) Inventor: David Douglas Winters, Clarksville, TN (US)

( * ) Notice: Subject to any disclaimer, the term of this patent is extended or adjusted under 35 U.S.C. 154(b) by 0 days.

(21) Appl. No.: 14/943,911

(22) Filed: Nov. 17, 2015

Related U.S. Application Data

(63) Continuation-in-part of application No. 14/316,037, filed on Jun. 26, 2014, now abandoned.

(51) Int. Cl.
*A45B 9/04* (2006.01)
*A45B 9/00* (2006.01)

(52) U.S. Cl.
CPC ..... *A45B 9/04* (2013.01); *A45B 2009/007* (2013.01)

(58) Field of Classification Search
CPC ..... A45B 2009/002; A45B 2009/005; A45B 2009/007
USPC ..... 135/75
See application file for complete search history.

(56) References Cited

U.S. PATENT DOCUMENTS 2,923,063 A 2/1960 Hansen
2,980,456 A * 4/1961 McMullin ..... F16B 7/105 403/104
4,027,687 A * 6/1977 McGowan ..... A61H 3/00 135/66
4,528,998 A * 7/1985 Gamm ..... A45B 9/00 135/75
4,616,668 A 10/1986 Battison
4,809,725 A 3/1989 Champigny
5,197,501 A * 3/1993 Ragatz ..... A45B 3/00 135/66
5,331,988 A * 7/1994 Harmon ..... A45B 9/00 135/65
5,433,551 A * 7/1995 Gordon ..... A47H 1/022 16/96 R
5,443,435 A 8/1995 Wilkinson
6,079,894 A * 6/2000 Obitts ..... A61H 3/02 135/75
6,328,048 B1 12/2001 Rivera, Sr.
6,749,227 B2 * 6/2004 Margid ..... A63C 11/221 135/75
2009/0159106 A1 * 6/2009 Schulz ..... A45B 9/02 135/75
2011/0315177 A1 * 12/2011 McGann ..... A45B 9/04 135/67
2013/0092203 A1 * 4/2013 Zaltron ..... F16B 7/149 135/75

* cited by examiner

*Primary Examiner* — Noah Chandler Hawk
(74) *Attorney, Agent, or Firm* — David D. Winters

(57) ABSTRACT

A multi-purpose device with concealed locking means having a first tube, sliding tube, lock hole, locking button hole, locking button, sheath, bias element, tip, handle, compression ring, and friction gasket.

8 Claims, 13 Drawing Sheets

122
100
102
124

122
100
102
104
114
110
112
124

122
100
102
104
114
110
112
124

122
100
102
104
114
110
112
124

122
100
102
178
124

MULTI-PURPOSE PERAMBULATION AID WITH CONCEALED LOCKING MEANS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of multi-purpose telescoping devices and more specifically to a multi-purpose device with concealed locking means, its preferred mode being that of a swagger stick which is extendable to function as a walking aid.

There are sundry utilitarian ornamental devices which may be carried by individuals for various purposes. In example, it is fashionable and useful to carry ornate walking sticks or canes to accent or enhance appearance, or to aid ambulation. Swagger sticks and/or devices such as field marshal batons or scepters may be carried as indications of rank and/or authority; canes may be carried by sightless people to assist movement from place to place.

These devices, according to purpose, may differ significantly in size, weight, and/or appearance. If an individual requires more than one such device, the result can be inconvenient and burdensome.

There are known devices which are adjustable in length but which have said length adjustment means or other undignified, purely utilitarian features conspicuously disposed upon them thereby severely detracting from their aesthetic appeal.

The instant multi-purpose device, by comprising concealed locking means, provides both for fast and easy conversion of the device from one purpose to another while preserving enhanced aesthetics necessary for formal wear, use with military uniforms, or employment as swagger sticks, batons, scepters, and the like. The instant invention is therefore a needed advancement in the art.

Generally, these length adjustable devices comprise an inner telescoping member slidable within an outer member having a series of longitudinally aligned holes. The inner member has an associated button device which extends through a hole in said inner member and engages a substantially aligned hole in the outer member. A bias element sustains the button in communication with said substantially aligned holes in the members. To adjust the length of the device, the button is depressed overcoming the bias element and disengaging the button from the aligned holes allowing the members to move so that the hole in the inner member may be aligned with an alternate hole in the outer member whereupon the bias element will return the button to engagement with said substantially aligned holes.

However, there are known problems with such arrangements. In example, when the button is depressed inwardly by a user's finger to overcome the bias element and to disengage said button from the telescoping sections and one section is moved relative another, there is a tendency for the telescoping sections to pinch the finger of the user during initial movement between sections being moved.

In U.S. Pat. No. 4,616,668 by Battison, the pinching problem is solved by encasing that portion of the outer member comprising holes with a flexible sheath which deforms allowing the button to be depressed sufficient distance for length adjustment while comprising a barrier between the user's finger and potentially pinching elements.

Also, it is known that sections tend to rattle because of play between said sections when external forces are applied, especially when the device is pushed against the ground by a user during ambulation.

Battison, in his above patent, solves the rattle problem by contriving his flexible sheath to exert back pressure against the bias element to press the inner section against the outer section with sufficient force to stabilize said sections against rattle causing movement caused by outside forces. This arrangement requires that the force exerted by the sheath not be great enough to overcome the bias element, but at the same time be greater than that force applied by a heavy man's striking the device against the ground and resting a large portion of his weight upon it; therefore, the opposing forces of Battison's bias element and his flexible sheath must be quite large causing length adjustment by applying force to overcome the bias element to be commensurately difficult.

This arrangement is also disadvantageous because, for the sheath to exert back pressure against the bias element, Battison requires that his button has to extend beyond the outer surface of the outer member sufficiently to distend said sheath to create said opposing back pressure. Because his sheath must occlude at least part of the aperture in the outer section. This can be disadvantageous because it limits the types and manner of decoration or embellishment of the sheath as will be shown presently. The range of decorative possibilities is also restricted by Battison's claimed limitation that his sheath cover only that portion of a telescoping member comprising holes.

In addition, the extreme amount of play between Battison's telescoping tubes increases the likelihood of a finger's being pinched therebetween. In contrast, the instant art by teaching minimum clearance between telescoping members and by teaching apertures having sufficient clearance between a finger and said telescoping members solves the pinching problem without Battison's restrictive bias element-flexible sheath back pressure arrangement.

The instant art, as demonstrated below, solves the pinching and rattle problems in manners different from Battison and accrue benefits not found in Battison.

BRIEF SUMMARY OF THE INVENTION

A primary object of the invention is to enable multiple functions with one telescoping device.

Another object of the invention is ease of conversion from one configuration to another.

Another object of the invention is enhanced appearance due to concealed locking and conversion means.

Yet another object of the invention is ease of disassembly.

Still another object of the invention is ease of disassociation of particular elements from one another.

Still yet another object of the invention is substitutability of parts.

Yet another object of the invention is a length adjustment means having essentially no pinch points.

Another object of the invention is to incorporate material not conducive to the transfer of heat so as not to become uncomfortably hot or cold to the touch.

Yet another object of the invention is to aid perambulation.

Still yet another object of the invention is to prevent pinching of a user's finger between telescoping members by exploiting contrived intrinsic properties of said members themselves rather than ancillary communicating elements.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a device with concealed locking means comprising: a flexible sheath, a first tube, a sliding tube, a locking button, and a bias element.

BRIEF DESCRIPTION OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

LIST OF COMPONENTS

Figures 1, 1A, 1B, 1C:
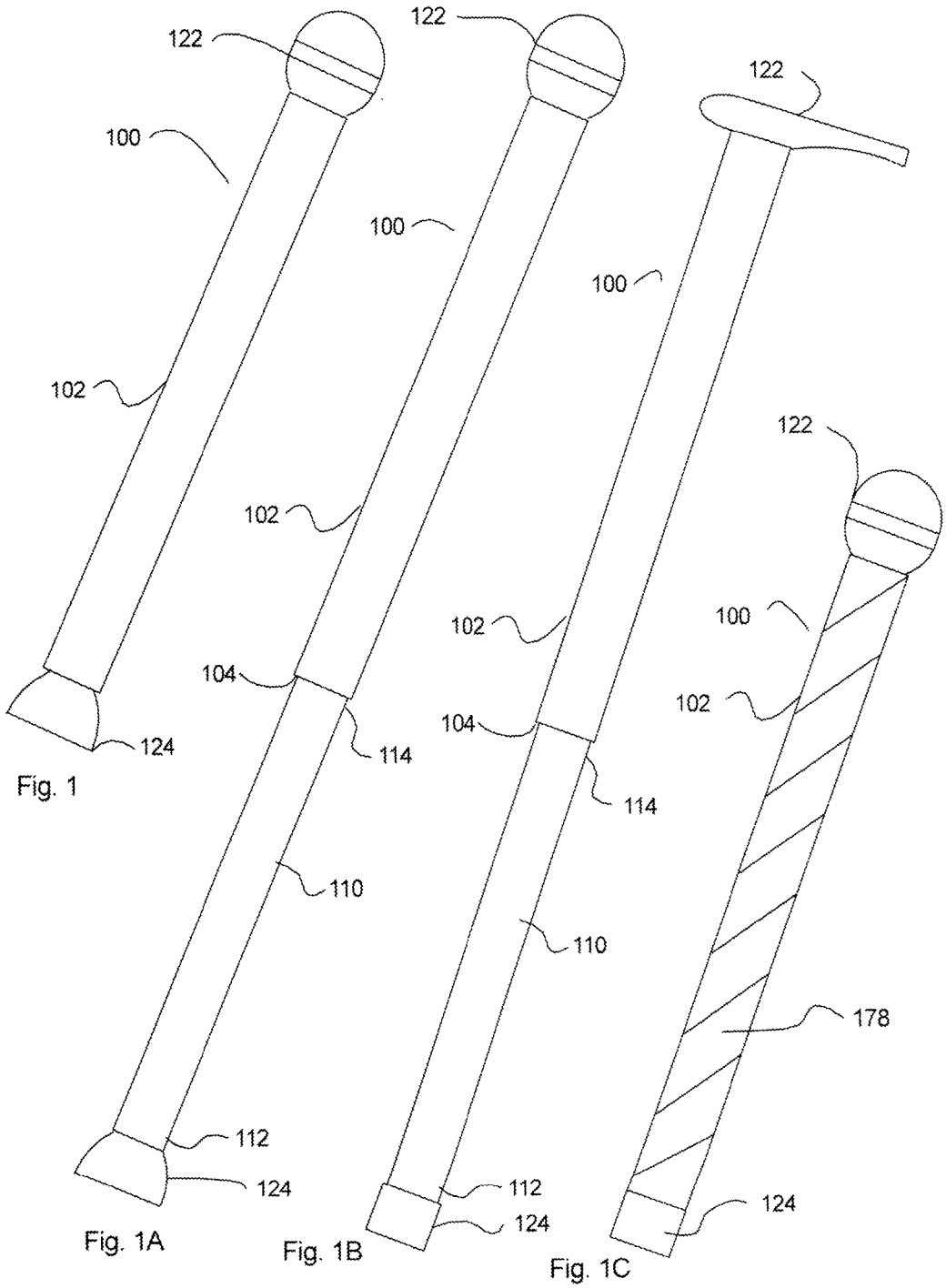
FIG. 1 is a front view of the invention with section retracted.
FIG. 1A is a front view of the invention with section extended.
FIG. 1B is a front view of the invention with section extended and alternate tip and handle.
FIG. 1C is a front view of the invention with section retracted, alternate tip as seen in FIG. 1B, and an alternate sheath embodiment.

100 Multi-purpose perambulation aid with concealed locking means
102 Sheath
103 Sheath surface
104 First tube
106 First tube distal end
108 First tube proximal end
110 Sliding tube
112 Sliding tube distal end
114 Sliding tube proximal end
116 Lock hole
118 Locking button
120 Bias element
122 Handle
124 Tip
126 Compression ring
128 Aperture
130 Distal end threads
132 Shoulder
134 Friction gasket
136 Locking button hole
138 Locking button shoulder
140 First tube surface
142 Rattle prevention means

144 Gasket clearance
146 Interior compression ring threads
147 Compression ring shoulder
148 First tube/sliding tube clearance
149 Design having irregular contour
150 Digit
152 Material not conducive to the transfer of heat
154 Button mounting stud
156 Mounting slot
158 Sliding tube plug
160 Sheath aperture, puncture, or slit
161 Locking button, locking button hole, lock hole clearance
166 Locking button contour
168 Design
170 Indicia
172 Physical indicia
174 Locking button guide channel
176 Locking button guide channel branch
178 Wrap
180 Extension mark
182 Dot
184 Indention
186 Circumscription
188 Length indicia
190 Educational cameo
192 Corresponding indicia
194 Compression ring distal edge
196 Locking button axis
198 Sheath lock hole contour

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

For the purpose of these specification and claims, the word "cameo" will be construed to mean: an image in relief, a two dimensional image as one that would be placed in a setting, or a short literary sketch or portrait of a person, writing, object, or historical event, all of which constructions are consistent with the word "cameo" as defined by the *Oxford English Dictionary*.

Figure 5:
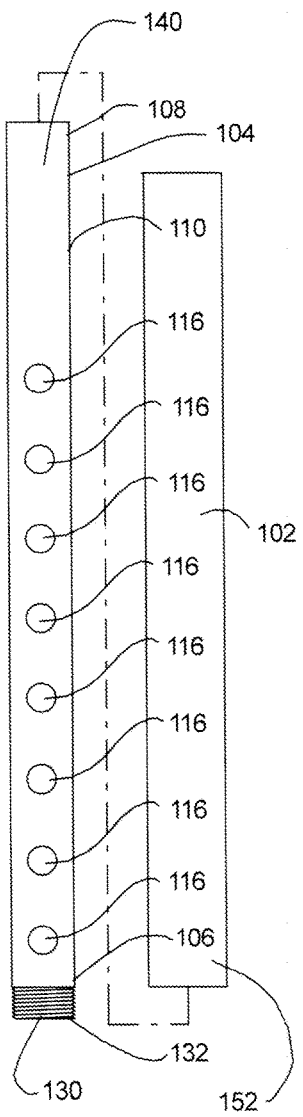
FIG. 5 is an elevational exploded view of elements of the invention.
Figure 5A:
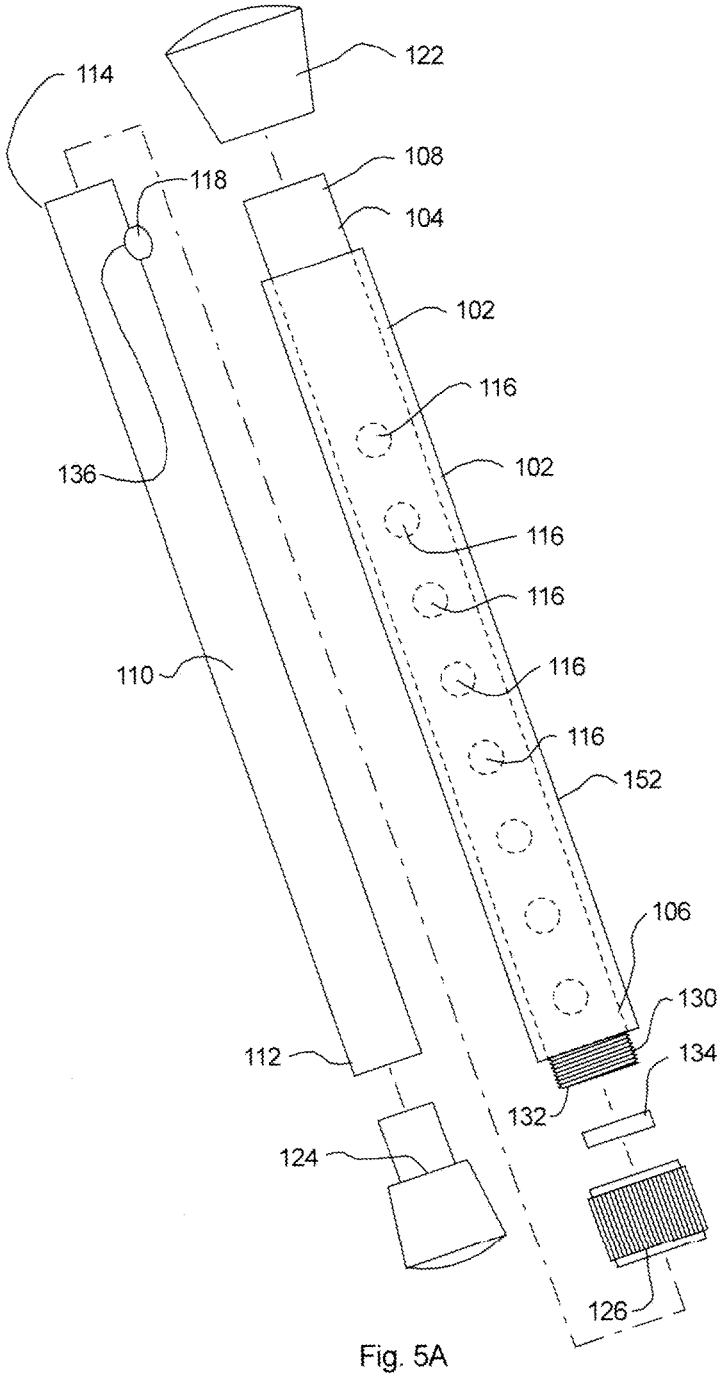
FIG. 5A is an elevational exploded view of elements of the invention.

FIGS. 1, 1A, 1B, 1C, 2, And 2A show a multi-purpose telescoping perambulation aid with concealed locking means (100) having a sheath (102) which conceals a portion of a first tube (104) having a distal end (106), a proximal end (108), and a surface (0.140) as seen in FIG. 5 and FIG. 5A. Also shown in FIG. 5 and FIG. 5A is a sliding tube (110) having a distal end (112) and a proximal end (114). The sliding tube (110) fits within the first tube (104) with minimum clearance necessary for the sliding tube (110) to move relative the first tube (104). Also noted in FIG. 1A and FIG. 1B is that the first tube proximal end (108) may comprise a handle (122) which may be embodied in sundry forms, which handles may be interchangeable. FIG. 1A and FIG. 1B also show that the sliding tube distal end (112) may comprise a tip (124) which may be embodied in various forms, which tips (124) may be interchangeable.

FIGS. 2, 2A, 5, and 5A show that the first tube (104) comprises a plurality of lock holes (116). Also shown is that the sliding tube (110) comprise a locking button hole (136) having dimensions essentially equal to those of the lock holes (116), and it will be readily appreciated that the first tube (104) and the sliding tube (110) are movable relative one another such that the locking button hole (136) is substantially alignable with any of the lock holes (116).

Figure 2:
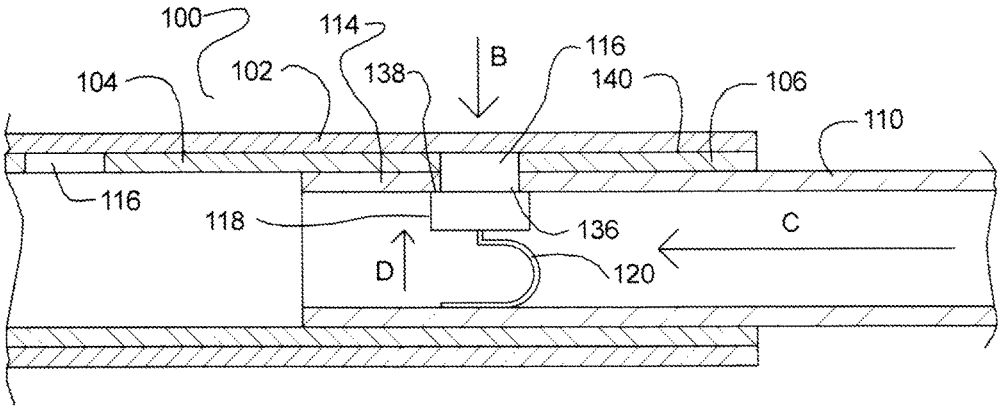
FIG. 2 is a cross sectional view of a portion of the invention.
Figure 5B:
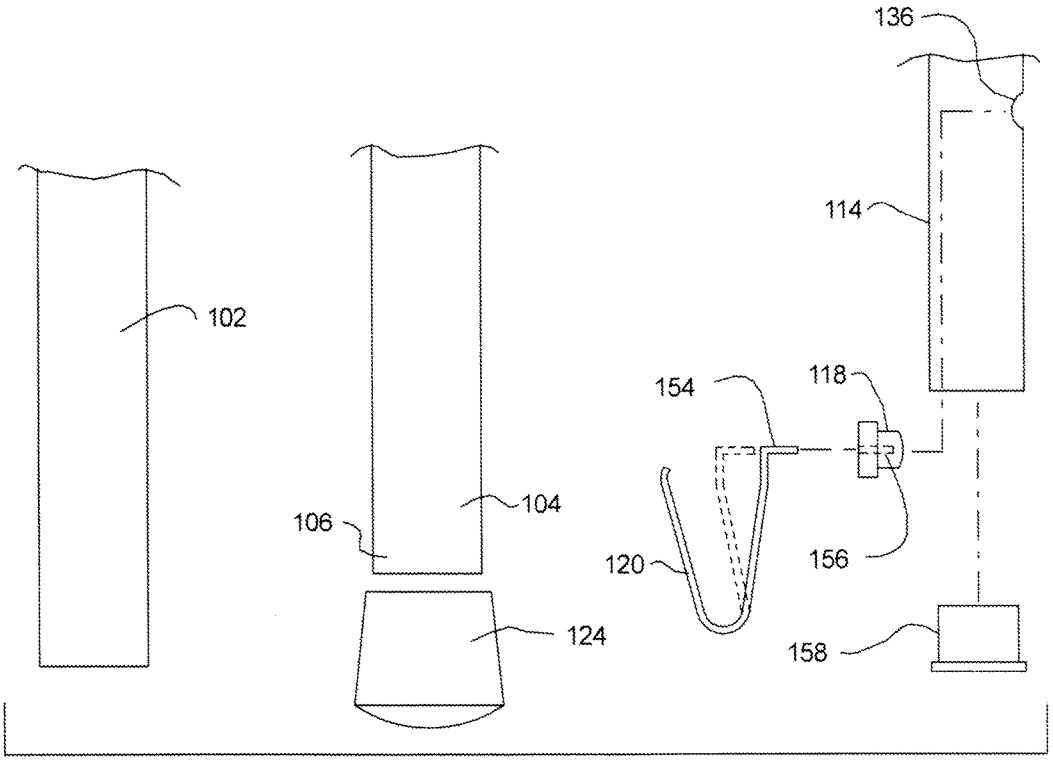
FIG. 5B is an elevational view of elements of the invention.

FIG. 2 shows the locking button (118) having a shoulder (138) and communicating with a bias element (120) by suitable means, in example FIG. 5B shows that the locking button (118) may comprise a mounting slot (156) which receives a bias element stud (154) extending from the bias element (120), said stud (154) and bias element (120) positioned and operating to allow aforementioned communication between said locking button (118), the lock hole (116), and locking button hole (136). Also in FIG. 2, it is seen that the locking button (118) extends through the aligned lock hole (116) and into the locking button hole (136) with minimum clearance necessary while the locking button shoulder (138) abuts the sliding tube (110) thereby limiting the extension of said locking button (118) through the lock hole (116) and locking button hole (136). It will be readily appreciated that said locking button (118) extension may be contrived so that the locking button (118) does not distend the sheath(102). FIG. 5B also shows that the sliding tube distal end (114) may comprise a plug (158).

Figure 5C:
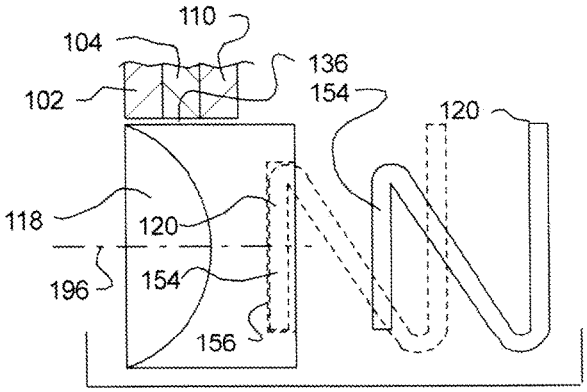
FIG. 5C is a side view of elements of the invention.
Figure 5D:
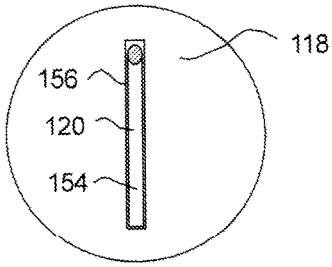
FIG. 5D is a bottom view of elements of the invention.

FIG. 5C and FIG. 5D show that the mounting slot (156) may be positioned essentially skew to the locking button axis (196), and that the button mounting stud (154) of the bias element (120) may be oriented skew to said locking button axis (196) in such a way as to fit within the mounting slot (156) in such a way as to prevent rotation of the locking button (118) relative said mounting stud (154) and/or the bias element (120) or vice versa. Now it will be understood that such rotation prevention may be exploited to prevent change in orientation of the locking button (118) relative the locking button hole (136), and/or the sheath (102), and/or the first tube (104), and/or the sliding tube (110).

Thus, it will be readily appreciated that said disposition of the locking button (118) will hold the first tube (104) in place relative the sliding tube (110) and that the locking button (118) may be contrived so that the locking button shoulder (138) limits extension of the locking button (118) beyond the first tube surface (140). Also noted is that the bias element (120) will tend to keep the first tube (104) and the sliding tube (110) in fixed position by biasing the locking button (118) in extended disposition as previously shown.

FIG. 2 also shows that when the locking button (118) is extended through the lock hole (116) and into the locking button hole (136), said locking button (118) may abut the sheath (102). Alternatively. As shown in FIG. 7F, the locking button (118) may distend the sheath (102) convexly at that point indicating which lock hole (116) is engaged. However, it will be understood that back pressure against the locking button (118) caused by the distended sheath (102) will be insignificant.

Figure 2A:
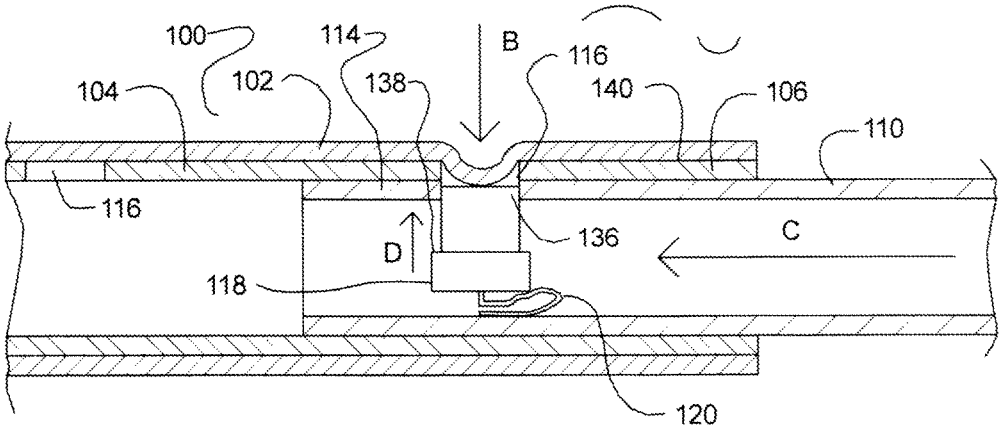
FIG. 2A is a cross sectional view of a portion of the invention.

FIGS. 2 and 2A show that the sheath (102) is flexible and/or resilient so that a force in direction B, as indicated by arrow, will distend the sheath (102) concavely whereupon said force in direction B will overcome the bias element (120) and move the locking button (118) sufficient distance to no longer extend into the lock hole (116) thusly allowing sliding tube (110) to be moved relative the first tube (104), in example in direction C as indicated by arrow. When force in direction B is not applied or is released, the sheath (102) will resume its original disposition, and the bias element (120) will return the locking button (118) to its original position by exerting force in direction D as indicated by arrow. In this original position, the sheath (102) by design can comprise a slight convex distension which can serve as an indication of a lock hole (116) location as in FIG. 7F. However, it will be understood that back pressure against the locking button (118) caused by the distended sheath (102) will be insignificant.

Figure 2B:
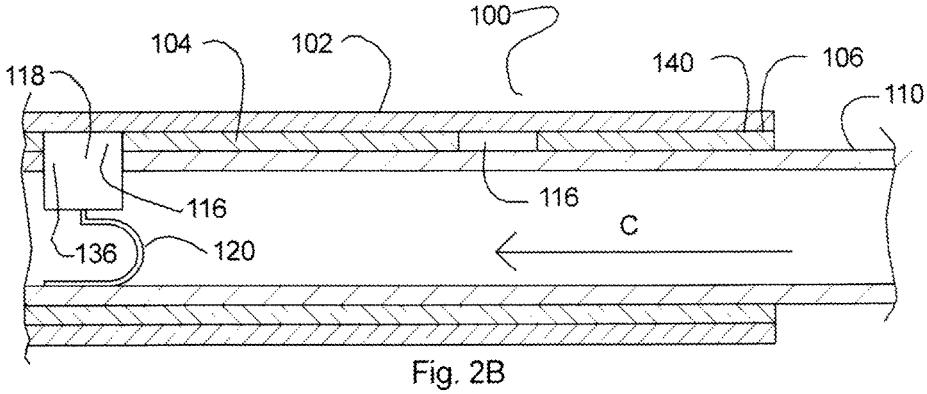
FIG. 2B is a cross sectional view of a portion of the invention.

FIG. 2B shows that the sliding tube (110) may then be moved so that the locking button hole (136) and the locking button (118) are essentially aligned with an alternate lock hole (116) whereupon the bias element (120) will cause the locking button (118) to extend through the locking button hole (136) and into the alternate lock hole (116) as previously described thusly fixing the first tube (104) relative the sliding tube (110) in an alternate relationship. FIG. 2B also shows that the bias element (120) may be contrived such that the locking button (118) is disposed in extension through the locking button hole (136) and into the lock hole (116) so as not to distend the sheath (102) in which case the locking button (118) need not comprise a shoulder (138).

Considering FIGS. 1, 1A, 1B, and 1C, it will be noted that the previously described disengagement of the locking button (118) with a lock hole (116) and re-engagement of said locking button (118) with an alternate lock hole (116) will adjust the length of the multi-purpose perambulation aid (100). Also, FIG. 2B indicates that when force in direction B, indicated by arrow, is released, the distended flexible and/or resilient sheath (102) will return to its original position. Therefore, the first tube (104) and the sliding tube (110) may telescope relative one another. Additionally, FIG. 1 and FIG. 1C show that the aforementioned length adjustment means may be contrived so that the tip (124) may be caused to essentially abut the sheath (102) and/or the first tube (104). Also shown is that the sheath (102) may essentially abut the handle (122) Thus the entire first tube surface (140) may be concealed by the sheath (102) thereby comprising an integral, uniform surface which may have embellishments or adornments of sundry types not marred by irregularities affected by transition from an exposed first tube surface (140) to the sheath (102).

Figure 8:
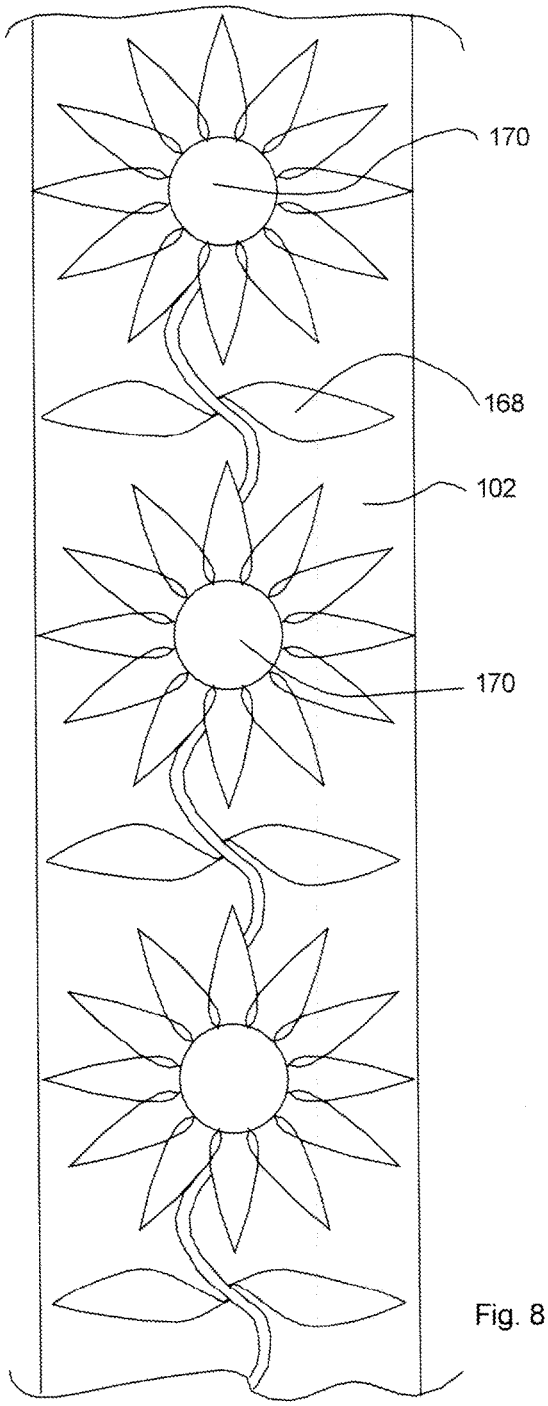
FIG. 8 is a front view of a portion of an embodiment of the invention.
Figure 8A:
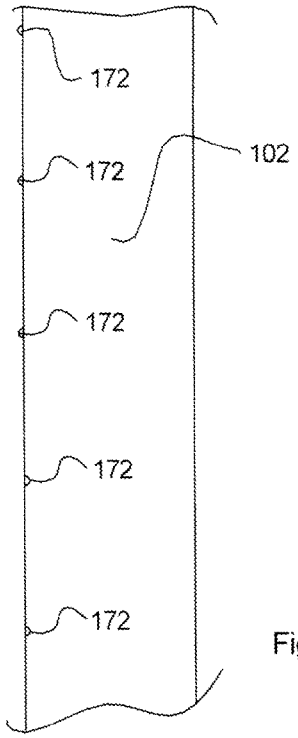
FIG. 8A is a side view of a portion of an embodiment of the invention.

Now one will readily appreciate that the sheath (102) conceals the locking button (118), lock holes (116), locking button hole (136), and the bias element (120). However, FIG. 8 shows that the sheath (102) may comprise a design (168) comprising indicia (170) of the lock hole (116) locations. FIG. 8A shows that the sheath (102) may comprise physical indicia (172) discernable by touch of the lock hole (116). Therefore, though the sheath (102) conceals the lock holes (116) and the locking button (118), the locations of same may be discerned by sight or feel. This would enable a blind person or a person walking in a crowded area, or crossing the street who should not divert his view from present surroundings to find the location of the locking button (118) by feel and, adjust the length of the multi-purpose perambulation aid (100) without having to locate and/or press the locking button (118) by sight. Those skilled in the art will readily appreciate that said physical indicia (172) may be small enough to be essentially not noticeable by sight without close examination but still discernable by feel. As previously mentioned, said physical indicia (172) may be comprised of a slight depression in the sheath (102) over each lock hole (116) or by slight convex bump in the sheath (102) where the locking button (118) is engaged in a lock hole (116).

However, FIG. 2B shows that the locking button (118) may be contrived not to extend beyond the first tube surface (140) so as not to distend the sheath (102). Said sheath (102), when not distended, thus presents a surface in no way indicative of what is ensheathed thereby.

FIG. 1B additionally shows that the sliding tube distal end (112) may comprise a tip (124) so that when the sliding tube (110) is fully extended relative the first tube, said tip (124) may be contrived to facilitate the use of the multi-purpose telescoping perambulation aid (100) in sundry ways, in example as a walking stick, a dress cane, a cane for a sightless person, a wand and the like as will be further described presently.

FIGS. 1, 1A, 1C, and 1D show that the instant perambulation aid (100) may comprise a handle (122) in addition to the tip (124). It will be therefore understood that that when the sliding tube (110) is fully extended, as in FIGS. 1B and 1C, the instant perambulation aid (100) may be used as a walking stick or other perambulation aid, or in any other fashion appropriate for an elongated structure with diameter relatively small compared to its length, in example a pointer, cane for a blind person, dress cane, and the like.

Referring to FIG. 1, it is additionally readily appreciated that the sliding tube (110) may be retracted into the first tube (104) a maximum distance so that the tip (124) is essentially contiguous the first tube (104). This is a notable convenience, as in the case of a person who might require walking aid only when ascending or descending stairs or traversing irregular terrain. Said person might carry the perambulation aid (100) in retracted disposition, perhaps in the unobtrusive manner of a swagger stick, and deploy it to full length only when occasion demands. Thus it is desirable to esthetically style the perambulation aid (100) for this purpose.

Now, one skilled in the art will readily appreciate that elements of the instant perambulation aid (100), in example the tip (124), the handle (122), and/or the sheath (102) may be ornamented to enhance aesthetics or to enhance the particular purpose for which the perambulation aid (100) is exploited. In example, a swagger stick or a dress cane might be baroque or rococo, such ornamentation better conveying status and/or increasing noticeability of the carrier.

Figure 3:
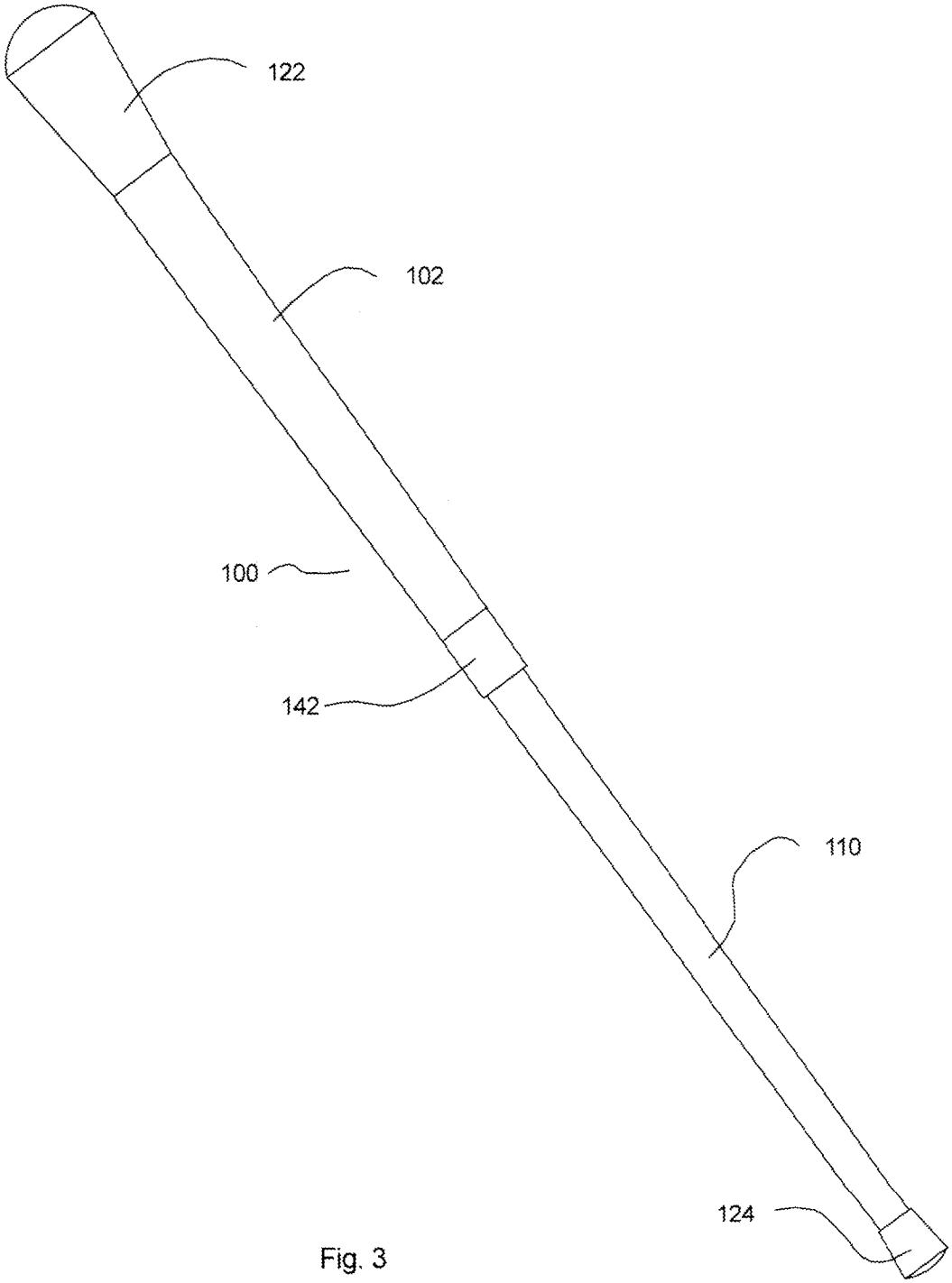
FIG. 3 is an elevational view of an embodiment of the invention.
Figure 3A:
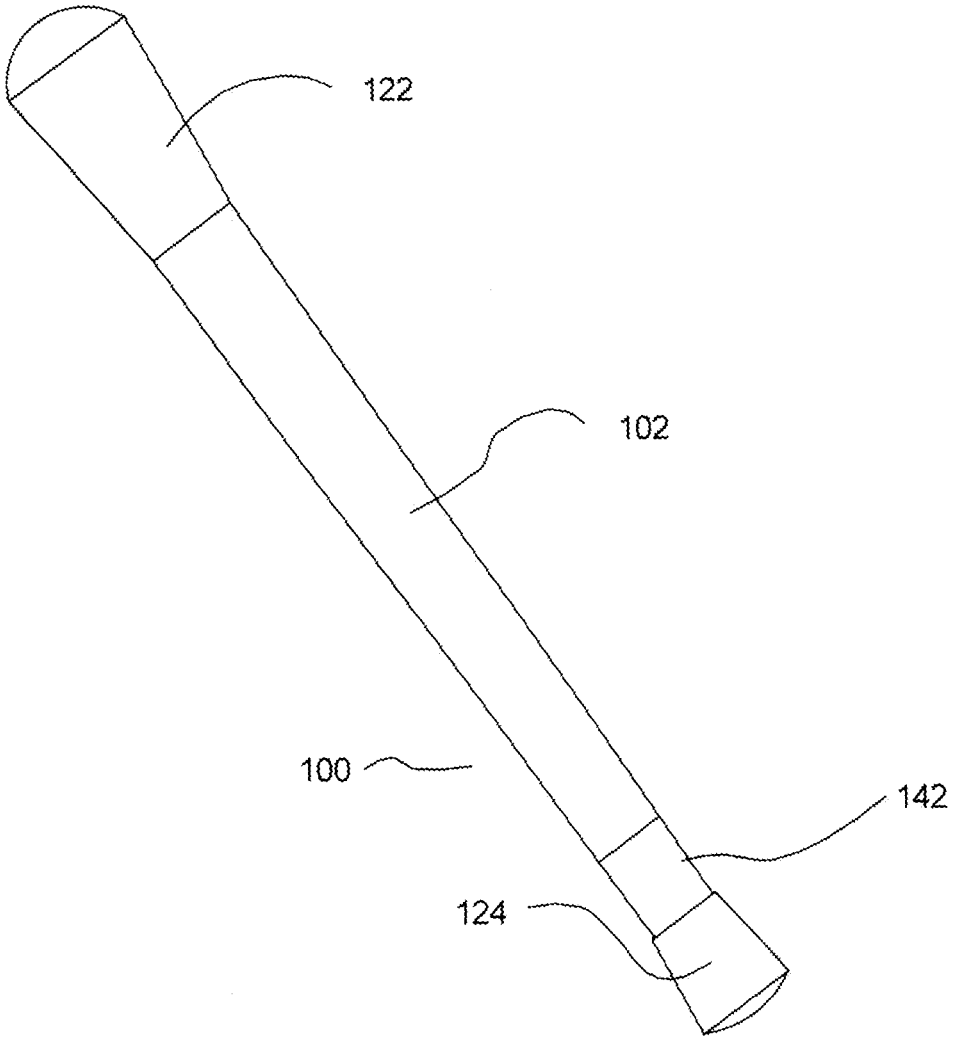
FIG. 3A s an elevational view of an embodiment of the invention.

FIGS. 3 and 3A show that the multi-purpose telescoping perambulation aid with concealed locking means (100) may comprise rattle prevention means (142). In example, FIG. 4 shows, in exploded view, the first tube (104) having distal end threads and a shoulder (132), a friction gasket (134) being flexible and/or resilient, a compression ring (126) having an aperture (128) extending therethrough, interior threads (146) gasket clearance (144) a distal edge (194), and a shoulder (147).

Figure 4:
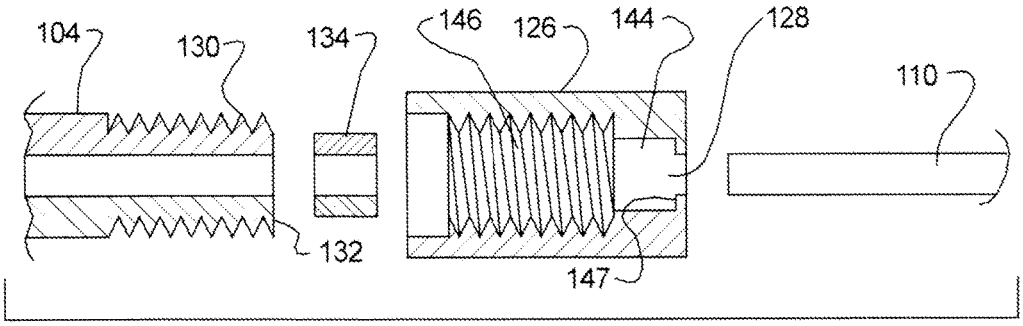
FIG. 4 is a cross sectional exploded view of elements of the invention.
Figure 4A:
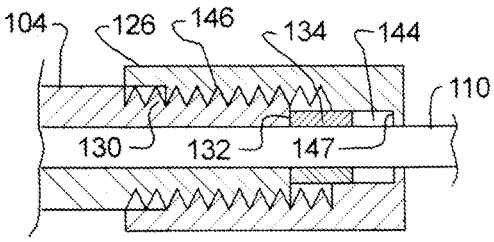
FIG. 4A is a cross sectional view of elements of the invention.
Figure 4B:
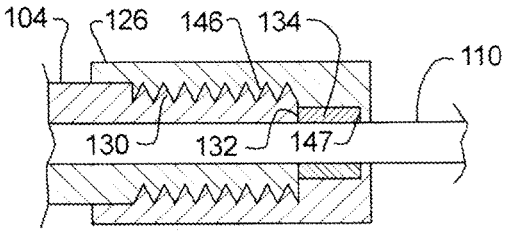
FIG. 4B is a cross sectional view of elements of the invention.

FIGS. 4A and 4B show that the sliding tube (110) extends through the compression ring (126) through the compression ring aperture (128) with minimum clearance, through the friction gasket (134) with minimum clearance, and into the first tube (104). Also, the first tube distal end threads (130) engage the interior compression ring threads (146) while the friction gasket (134), with the sliding tube (110) passing therethrough, is disposed in the gasket clearance (144) essentially abutting the first tube shoulder (132) and with minimum clearance between the compression ring (126) and the sliding tube (110).

Figure 4C:
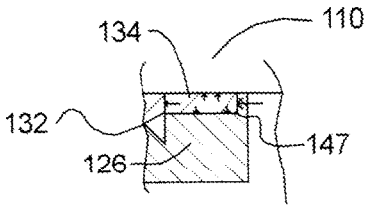
FIG. 4C is a cross sectional view of elements of the invention.

Now considering FIGS. 4, 4A, and 4B, it will be readily appreciated that, according to well known principles, in example rotating the compression ring (126) as the first tube distal end threads (130) engage the interior compression ring threads (146), the compression ring (126) may be moved in direction C, indicated by arrow, relative the first tube (104). The compression ring shoulder (147) will then engage the friction gasket (134) while the friction gasket (134) abuts the first shoulder as seen in FIG. 4B. Thus, one skilled in the art will readily appreciate that, as shown in FIG. 4C, as the compression ring (126) moves in direction C, indicated by arrow, force will be transferred to the friction gasket (134) through the compression ring shoulder (147) and due to the resiliency and/or flexibility of the friction gasket (134), force will be transferred, as indicated by arrows, from the friction gasket (134) to the compression ring (126) and the sliding tube (110) causing friction therebetween. Now it will be understood that said friction and the communication of the compression ring (126) with the first tube (104) may be sufficient to prevent free play or rattle of the first tube (104) relative the sliding tube (110). It will also be understood that the previously described minimum clearance between the first tube (104) and the sliding-tube (110) will serve to prevent rattle.

FIG. 3 and FIG. 3A additionally show that the sliding tube distal end (112) may comprise a tip (124) such that when the sliding tube (110) is fully extended relative the first tube (104) so that length of the multi-purpose perambulation aid (100) is maximum, said tip (124) may be contrived to facilitate the use of the multi-purpose perambulation aid with concealed locking means (100) in sundry ways, in example as a walking stick, a dress cane, a cane for a sightless person, and the like. Also, one skilled in the art will readily appreciate that with a plurality of lock holes (116), the length of the multi-purpose perambulation aid may be adjusted to accommodate, for example, different terrains, or purposes, or users of different heights.

Also seen in FIG. 3 and FIG. 3A is that the tip (124) may be contrived so that when the sliding tube (110) is fully retracted into the first tube (104) so that the length of the multi-purpose telescoping perambulation aid with concealed locking means (100) is minimum and/or the tip (124) abuts the compression ring (126), said tip (124) and said compression ring (126) will appear to be an integral structure with the purposes of said tip (124) and said compression ring (126) not obvious to an observer.

FIG. 5, FIG. 5A, and FIG. 5B show that the components of the multi-purpose perambulation aid with concealed locking means (100) may be easily disassociated from one another, and it will be readily appreciated that said perambulation aid may be re-assembled with equal ease. Seen in disassociated state are the first tube (104), sliding tube (110), tip (124), handle (122), sheath 102), compression ring (126), friction gasket (134), shoulder (132), locking button (118) distal end threads (130), and bias element (120).

One skilled in the art will readily appreciate that due to the disassemblibility of the multi-purpose perambulation aid (100) seen in FIGS. 5 and 5A, a plurality of different handles (122) may be contrived to communicate functionally with the first tube (104) and that a plurality of different tips (124) may be contrived to communicate with the sliding tube (110) as seen in FIGS. 1A and 1B. Therefore as seen in FIGS. 1A and 1B, a number of tips (124) and handles (122) may be interchangeable respectively, thusly enhancing the versatility of the multi-purpose perambulation aid (100).

One skilled in the art will readily appreciate that the sheath (102) may comprise a material not significantly heat conductive (152), in example a material having a thermal conductivity of less than one watt per meter degree kelvin, to or from the first tube (140) as seen in FIG. 5. Therefore said sheath (102) will insulate the first tube surface (149) from becoming uncomfortably cold or hot to the touch as might otherwise occur in extreme climactic environments. Said sheath (102) comprising said material (152) will tend to protect against freezing of a hand grasping it. This is especially important in cold environments and if the tubes (104, 110) comprise highly heat conductive material, in example metal.

One skilled in the art will understand that the length of the multi-purpose perambulation aid (100), the handle (122) and/or the tip (124) or other element may be easily adjusted to change the function of said multi-purpose perambulation aid (100), in response to a wide range of needs for balance assistance, weight support, or ceremony.

Figure 7:
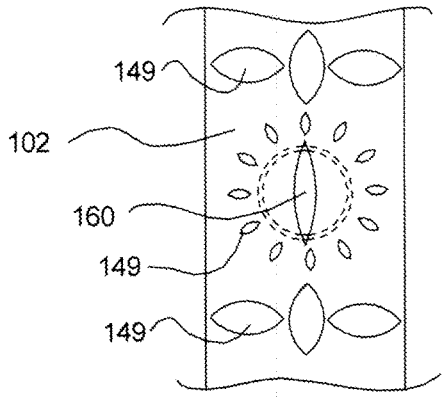
FIG. 7 is a top view of a portion of the invention.
Figure 7A:
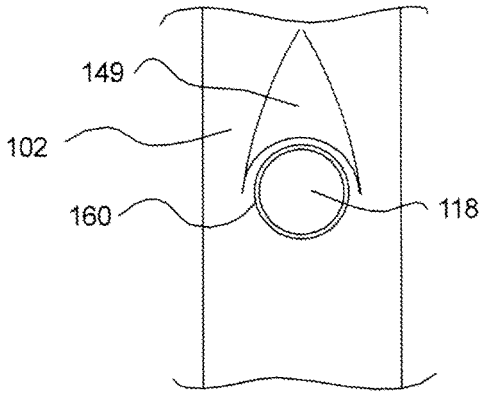
FIG. 7A is a top view of a portion of the invention.
Figure 7B:
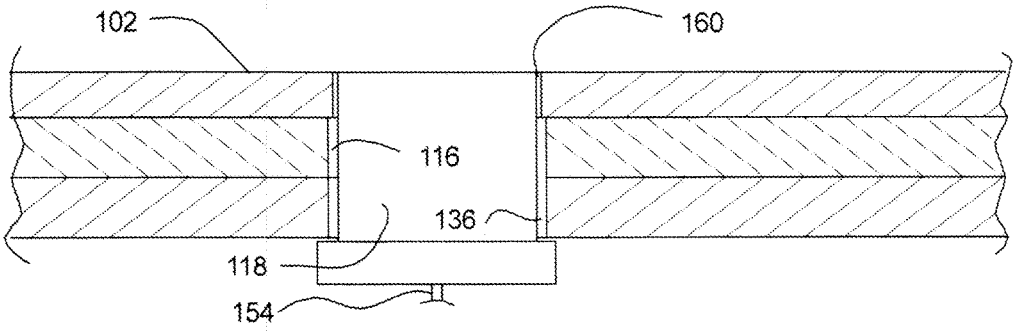
FIG. 7B is a cross sectional view of a portion of the invention.
Figure 7C:
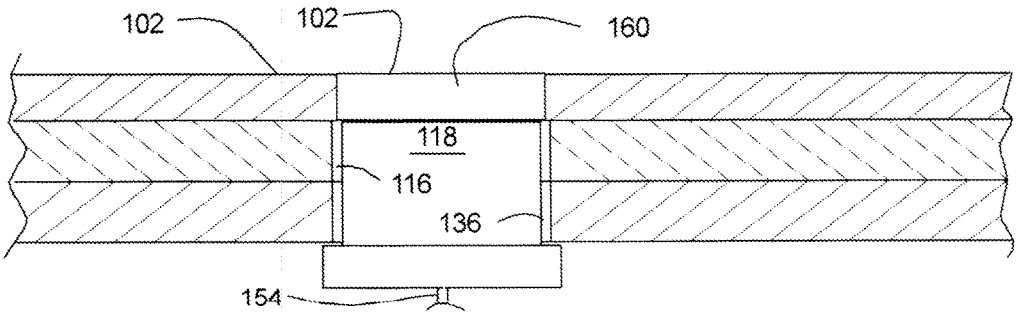
FIG. 7C is a cross sectional view of a portion of the invention.

FIG. 7, FIG. 7A, FIG. 7B, and FIG. 7C show that the sheath (102) may comprise one or more punctures, apertures, or slits (160) disposed in one or more positions corresponding to the position of a lock hole (116) so that when said lock hole (116) is essentially aligned with the locking button hole (136), the locking button (118) will extend through said locking button hole (136) and through said lock hole (116) and against, along side, or into said aperture, puncture or slit (160). Now it will be readily appreciated that that an aperture, puncture, or slit may comprise an area sufficient for said locking button (118) to pass into said aperture, puncture, or slit (160) with little or no contact with the sheath (102) as in FIG. 7A and FIG. 7B, or the aperture, puncture, or slit (160) may comprise an area such that the locking button (118) will contact the sheath (102) when extending into said aperture (160) as in FIG. 7 and FIG. 7C and that contact may distend the sheath (102) noticeably as in FIG. 7F, or may distend it little or not at all as shown in FIG. 7C. Now it will be understood that the aperture (160) as shown in FIG. 7 and FIG. 7C may comprise a design having an irregular contour (149) in example a relief type or bas relief type.

Figure 7D:
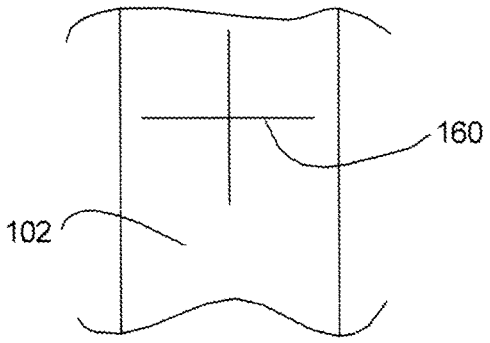
FIG. 7D is a partial view of an embodiment of the invention.
Figure 7E:
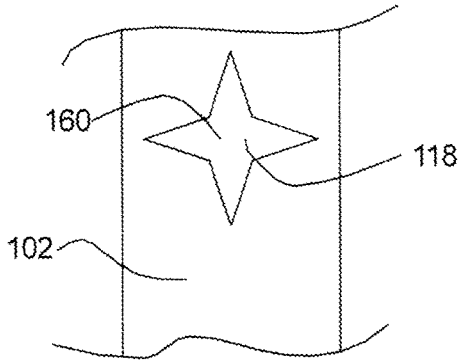
FIG. 7E is a partial view of an embodiment of the invention.
Figure 7F:
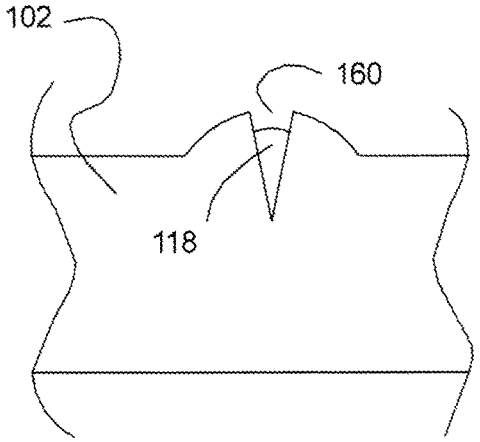
FIG. 7F is a partial view of an embodiment of the invention.

FIG. 7D shows that the previously described biased position of the locking button (118) might not distend the sheath (102) so that the configuration of the aperture, puncture, or slit (160) is not affected by extension of the locking button (118) into and/or through the lock hole (116) and/or the locking button hole (136). FIGS. 7E and 7F show that the locking button (118) might extend into and/or through the lock hole (116) to the extent that the sheath (102) is distended and the aperture, puncture, or slit (160) is enlarged and/or the configuration of said aperture, puncture, or slit (160) is altered. However, it will be readily appreciated that the opposing forces of the bias element (120) and the sheath (102) caused by the extension of the locking button (118) through the lock hole (116) may be the minimum necessary with the difference therebetween insufficient for any purpose other than maintaining the locking button (118) in operative disposition as previously described.

Figure 6:
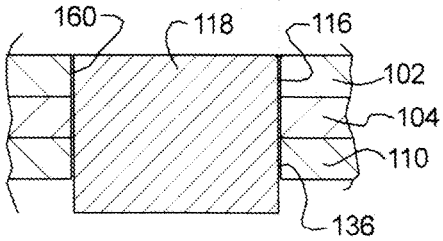
FIG. 6 is a cross sectional view of a portion of the invention.
Figure 6A:
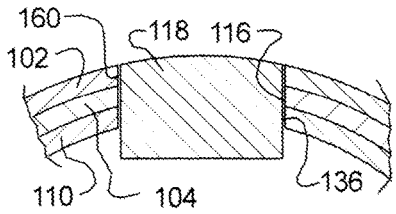
FIG. 6A is a cross sectional view of a portion of the invention.

In addition, the longitudinal section seen in FIG. 6 and the cross section seen in FIG. 6A, both depicting the same locking button (118), show that said locking button (118) may comprise a contour (166) conforming essentially to the sheath surface (103). In addition, it will be noted that the locking button (118) and/or associated elements may be contrived to extend to a point such that the locking button contour (166) and the sheath surface (103) are essentially contiguous.

Figure 6B:
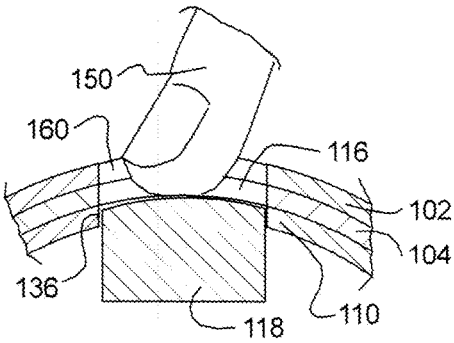
FIG. 6B is a cross sectional view of a portion of the invention
Figure 6C:
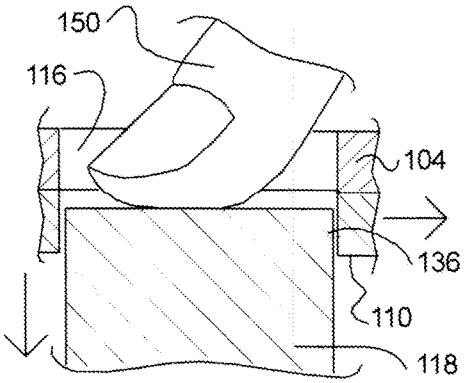
FIG. 6C is a cross sectional view of a portion of the invention.
Figure 6D:
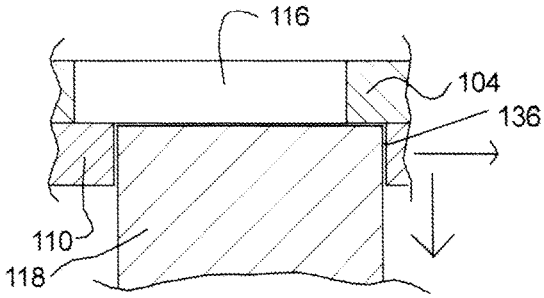
FIG. 6D is a cross sectional view of a portion of the invention.

FIG. 6B and FIG. 6C show that the locking button (118) may be depressed, in example by a user's digit (150) to the point that the sliding tube (110) may be moved, in example in direction indicated by arrow, relative the first tube (104). FIG. 6D shows that when the sliding tube (110) has been moved in direction indicated by arrow to the point that a portion of the locking button (118) may contact a portion of the first tube (104) due to operation of the bias element (120) as previously described, thusly preventing extension of said locking button (118) into the lock hole (116), the digit (150) may be removed leaving the locking button (118) in position not preventing movement of the sliding tube (110) relative the first tube (104), and the sliding tube (110) may be moved to position the locking button (118) into alignment with an alternate lock hole (116) thusly adjusting the length of the multi-purpose perambulation aid (100) as previously shown. It will therefore be understood that removal of the digit (150) prior to the completion of the previously described alignment of the locking button hole (136) with an alternate lock hole (116) will prevent pinching of said digit (150) between the first tube (104) and the sliding tube (110).

Now it will be readily appreciated that by removal of the digit (150) prior to the movement of the locking button (118) and the communicating sliding tube (110) so that the locking button (118) has no position contiguous to the lock hole (116) or occluding the lock hole (116), the possibility of said digit's (150) being pinched between the first tube (104) and the sliding tube (110) is essentially eliminated. Also, the minimum clearance (148), as previously described, between the first tube (104) and the sliding tube (110) and the minimum clearance (161) between the lock hole (116), the locking button hole, and the locking button (118) will also mitigate pinching of any digit (150) depressing the locking button (118). Further, when depressing the locking button (118), the sheath (102) protects against pinching skin of the digit (150) between the locking button (118) and the edge of the lock hole (116).

Figure 10:
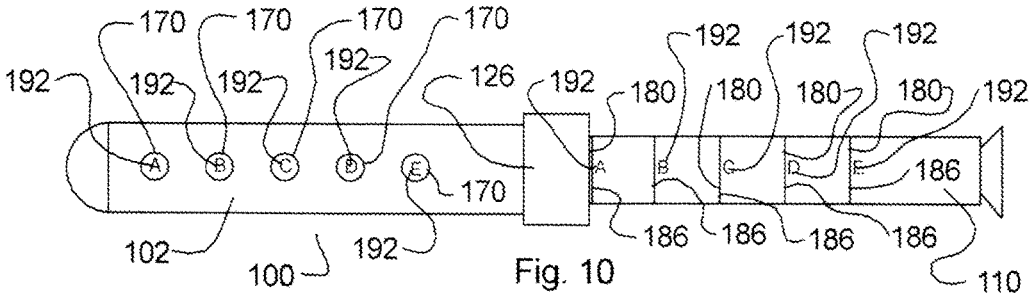
FIG. 10 is a top view of an embodiment of the invention

FIG. 10 shows that the sliding tube (110) may comprise extension marks (180) at one or more selected points with which the user may align the compression ring distal edge (194) thusly indicating position of the compression ring (126) relative said sliding tube (110) when the locking button (118) engages corresponding lock holes (116) in the first tube (104). Also noted is that lock hole location indicia (170) and the extension marks (180) may comprise corresponding indicia (192) in example here represented by letters "A," "B," "C," "D," and "E." Therefore, it will be understood that when the locking button (118) engages the lock hole (116) indicated by the letter "A," in example, the extension of the sliding tube (110) relative the compression ring (126), in particular the distal edge (194) thereof, will be indicated by the extension mark (180) designated by the corresponding letter "A" on the sliding tube (110).

Figure 10A:
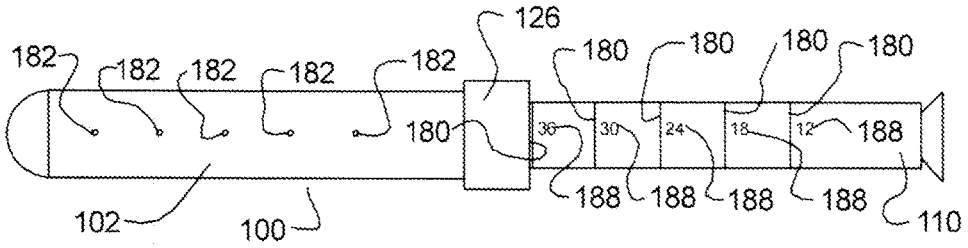
FIG. 10A is a top view of an embodiment of the invention

FIG. 10A shows that the sliding tube (110) may comprise one or more length indicia (188) associated with the one or more extension marks (180), which one or more length indicia (188) may indicate the length of the perambulation aid (100) when the compression ring distal edge (194) is essentially contiguous the extension mark (180) indicated by said length indicia (188).

Figure 10B:
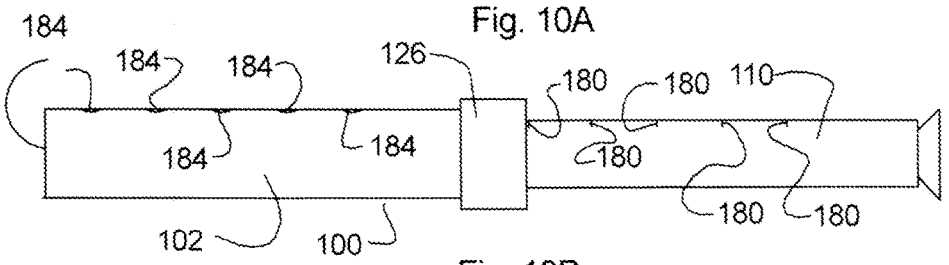
FIG. 10B is a side view of an embodiment of the invention

FIG. 10B shows that the sheath (102) may comprise one or more indentions (184) at the location of one or more lock holes (116). It will be understood that said one or more said indentions (184) may be discerned by feel and/or sight thusly enabling location of said one or more lock holes (116) thereby.

FIG. 10 and FIG. 10A show that the extension marks (180) may comprise circumscription (186) of the sliding tube (110). FIG. 10B shows that the one or more extension marks (180) need not circumscribe the sliding tube (110).

Figure 10C:
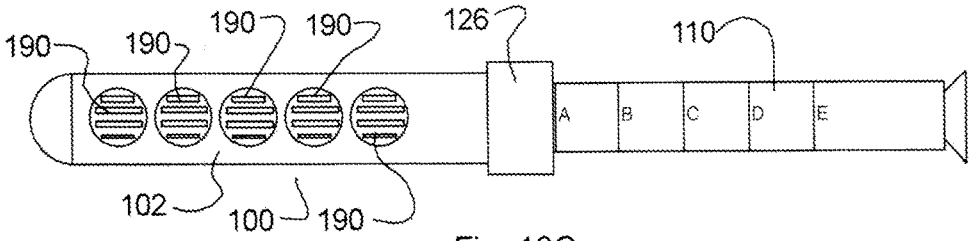
FIG. 10C is a top view of an embodiment of the invention.

FIG. 10C shows that the sheath (102) may comprise one or more pictorial cameos (190) and that the location of said one or more cameos (190) may correspond to the location of one or more lock holes (116).

Figure 10D:
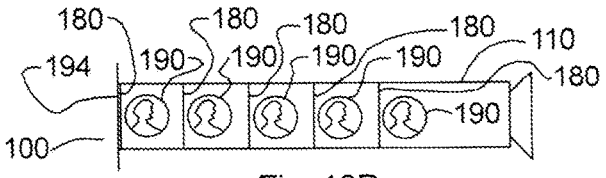
FIG. 10D is a partial side view of an embodiment of the invention.

FIG. 10D shows that the extension marks (180) might, to make them easy to remember, be annotated with small illustrations contrived to correspond with lock hole location indicia (170). In example, the cameos (190) may be historic in nature representing American presidents, in order of office, the most recent logically representing the "A" hole, the preceding the "B" hole and so on.

FIG. 10A shows that, alternatively, the lock hole location indicia (170) may comprise dots (182) contrived to be unobtrusive yet tactilly or visually discernable.

Figure 8B:
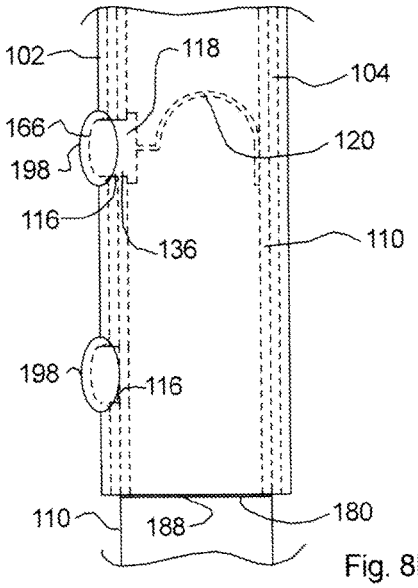
FIG. 8B is a side view of a portion of an embodiment of the invention.

FIG. 8B shows that the sheath (102) may comprise one or more lock hole convex contours (198) which may be disposed such that when the sheath (102) is in operative position, said one or more lock hole convex contours (198) will be located essentially contiguous to one or more lock holes (116). Also noted is that said sheath lock hole convex contours (198) may correspond essentially to the locking button contour (166). Therefore, when the looking button (118) is extended through an essentially aligned lock hole (116) and locking button hole (136), said locking button (118) may abut the sheath lock hole convex contour (198). It will be understood, that, as previously described, the sliding tube (110) may comprise one or more extension marks (180) and/or length indicia (188) which will indicate which lock hole (116) is aligned with the locking button (118).

Figure 9:
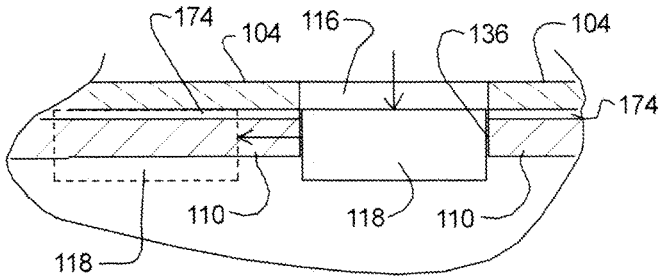
FIG. 9 is a cross sectional view of a portion of the invention.
Figure 9A:
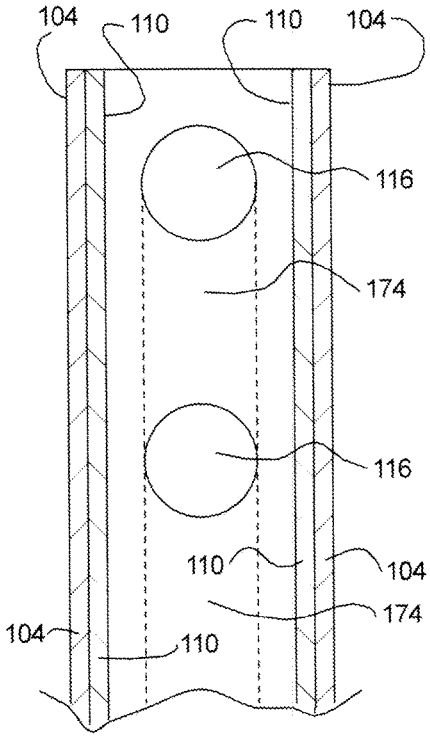
FIG. 9A is a cross sectional view of a portion of the invention.
Figure 9B:
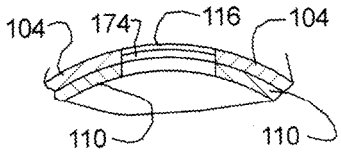
FIG. 9B is a cross sectional view of a portion of the invention.

FIG. 9, FIG. 9A, and FIG. 9B show that the first tube (104) may comprise a locking button guide-channel (174) having a width greater than the width of the locking button (118). Said channel (174) may extend longitudinally from the most distal lock hole (116) to the most proximal lock hole (116). Thus, it will be readily appreciated that when the locking button (118) is depressed to disengage from the first tube (104) to initiate length adjustment as previously described, as indicated by vertical arrow in FIG. 9, the locking button (118), having a width less than the width of said channel (174), may slide within the channel (174) thusly being guided thereby to an alternate lock hole (116). Further, it will be readily appreciated that the width difference between the locking button (118) and the locking button guide-channel (174) may be the minimum necessary to allow entry of said locking button (118) into said channel (174). Also, the channel (174) may comprise a contour essentially congruent with the locking button contour (166).

Figure 9C:
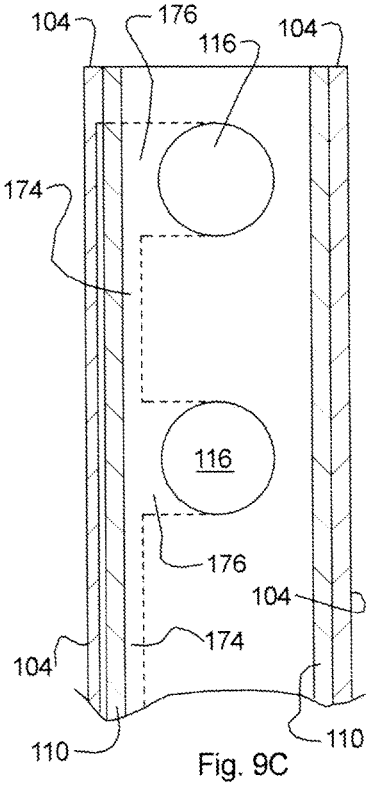
FIG. 9C is a cross sectional view of a portion of the invention.
Figure 9D:
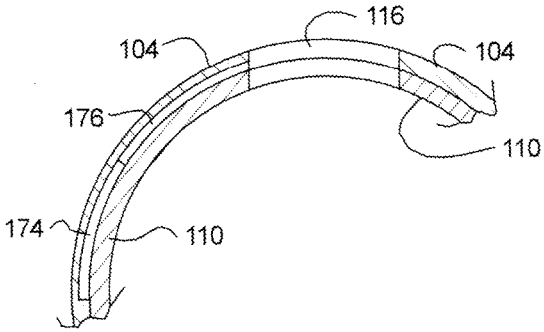
FIG. 9D is a cross sectional view of a portion of the invention.

FIG. 9C and FIG. 9D show that the locking button guide-channel (174) may extend longitudinally relative the first tube (104) but not essentially co-linearly and/or coaxially with the lock hole (116). In such instance, the locking button guide-channel may comprise a locking button guide-channel branch (176) extending from said channel (174) to the lock hole (116). One skilled in the art will, therefore, readily appreciate that by disengagement of the locking button (118) from the lock hole (116) and appropriate manipulation of the sliding tube (110) relative the first tube (104), the locking button (118) will travel from its locking orientation with the lock hole (116) through the locking button guide-channel branch (176) to the locking button guide-channel (174) then within said channel (174) to an alternate locking button guide-channel branch (176) and ultimately to orientation with an alternate lock hole (116) whereupon the locking button (118) will extend into said alternate lock hole (116) and function as previously described.

While the invention has been described in connection with a preferred embodiment, it is not intended to limit the scope of the invention to the particular form set forth, but on the contrary, it is intended to cover such alternatives, modifications, and equivalents as may be included within the spirit of the scope of the invention as defined by the appended claims.

I claim:

1. A multi-purpose telescoping perambulation aid with concealed locking means comprising;

an essentially straight tube comprising, a proximal end, a distal end comprising threads, and a surface, one or more lock holes;

an essentially straight sliding tube inserted into the first tube with minimum clearance sufficient to allow said sliding tube to move in a telescoping manner relative to said first tube, said sliding tube having;

a proximal end, a distal end, and a locking button hole, said locking button hole essentially alignable with one or more individual first tube lock holes;

a flexible sheath essentially ensheathing portions of the first tube not covered by other components, said sheath comprising one or more indicia each indicium proximal to a corresponding lock hole rendering the location of said lock hole discernable visually or alternatively or concurrently by touch;

a locking button extendable through the locking button hole and into any essentially aligned lock hole, the lock hole having sufficient diameter to permit depression of the locking button by a digit as to allow the first tube and the sliding tube to move in a telescoping manner relative one another;

a bias element biasing the locking button to a disposition extended through the locking button hole and into any essentially aligned lock hole, said biased disposition of the locking button causing essentially no distension of the sheath;

a walking surface contact tip on the distal end of the sliding tube;

a handle on the proximal end of the first tube;

a compression ring having threads communicable with said first tube distal end threads; and a friction gasket within said compression ring capable of being tightened against the sliding tube in such a way as to prevent free play or rattle.

2. A perambulation aid as in claim 1 wherein said sliding tube comprises one or more indicia corresponding to alignment of the locking button with one or more said lock holes.

3. A perambulation aid as in claim 1 having a locking button comprising a contour essentially congruent with a contour of the sheath.

4. A perambulation aid as in claim 1 wherein said flexible sheath indicia comprise one or more concave indentions, each indicating the position of a corresponding lock hole.

5. A device as in claim 1 also comprising a locking button guide channel extending contiguously with one or more lock holes in such a way as to guide the locking button to a selected lock hole.

6. A multi-purpose telescoping perambulation aid with concealed locking means comprising;

an essentially straight first tube comprising, a proximal end, a distal end comprising threads, a surface, and one or more lock holes;

an essentially straight sliding tube inserted into the first tube with minimum clearance sufficient to allow said sliding tube to move in a telescoping manner relative to said first tube, said sliding tube having;

a proximal end, a distal end, and a locking button hole, said locking button hole essentially alignable with one or more individual first tube lock holes;

a flexible sheath essentially ensheathing portions of the first tube not covered by other components, said sheath comprising one or more indicia each indicium proximal to a corresponding lock hole rendering the location of said lock hole discernable visually or alternatively or concurrently by touch;

a locking button extendable through the locking button hole and into any essentially aligned lock hole, the lock hole having sufficient diameter to permit sufficient depression of the locking button by a digit as to allow the first tube and the sliding tube to move in a telescoping manner relative one another;

a bias element biasing the locking button to a disposition extended through the locking button hole and into any aligned lock hole, said biased disposition of the locking button causing essentially no significant back pressure against said locking button by the sheath;

the first tube further comprising a locking button guide-channel extending contiguously with one or more lock holes in such a way as to guide the locking button into a selected lock hole;

a walking surface contact tip on the distal end of the sliding tube;

a handle on the proximal end of the first tube;

a compression ring having threads communicable with said first tube distal end threads; and a friction gasket within said compression ring capable of being tightened against the sliding tube in such a way as to prevent free play or rattle.

7. A perambulation aid as in claim 6 wherein said flexible sheath indicia comprise one or more concave indentions, each indicating the position of a corresponding lock hole.

8. A multi-purpose device configurable and reconfigurable as a staff or walking stick, or alternatively as a baton, swagger stick, or wand comprising:

an essentially straight tube having, a proximal end, a distal end comprising threads, a shoulder proximal said first tube distal end, and one or more lock holes, a grip on the proximal end of the first tube;

an essentially straight sliding tube insertable into the first tube with minimally sufficient clearance to allow said sliding tube to move in a telescoping manner relative to said first tube, said sliding tube having, a proximal end, a distal end, and a locking button hole, said locking button hole essentially alignable with one or more individual first tube lock holes;

a flexible or alternatively or concurrently resilient sheath ensheathing exterior otherwise exposed portions of the first tube, said sheath comprising indicia discernable by sight corresponding to the location of a lock hole, or, alternatively or concurrently indicia discernable by touch corresponding to the location of the location of a lock hole;

a locking button extendable through the locking button hole and into any essentially aligned lock hole, thereby locking the sliding tube and first tube into a fixed position relative each other in such a way as to permit the locking button to be depressed by a user's finger or thumb upon the portion of the sheath directly contiguous to the locking button sufficiently to allow the first tube and the sliding tube to move relative one another in a telescoping manner;

a bias element biasing the locking button toward a disposition extended through the locking button hole and into any essentially aligned lock hole, said biased position of the locking button causing minimum opposing force resultant from distension of the sheath by said locking button;

a traction tip on the distal end of the sliding tube;

a handle on the proximal end of the first tube:

a compression ring having, threads communicable with said first tube distal end threads, and a gasket clearance;

a gasket, said gasket disposed within said gasket clearance, said gasket compressible between the compression ring and the first tube distal end shoulder, in such a way that the gasket tightens upon the sliding tube in response to compression between the compression ring and the first tube shoulder thereby limiting lateral motion or rattle of the sliding tube against the first tube; and a locking button guide channel extending contiguously between one or more lock holes in such a way as to guide the locking button to a selected lock hole.

* * * * *